US008066151B2

(12) United States Patent
Valvano, Jr.

(10) Patent No.: US 8,066,151 B2
(45) Date of Patent: Nov. 29, 2011

(54) MEASURING FLUID DISPENSER

(76) Inventor: Michael A. Valvano, Jr., Coral Springs, FL (US)

( * ) Notice: Subject to any disclaimer, the term of this patent is extended or adjusted under 35 U.S.C. 154(b) by 1351 days.

(21) Appl. No.: 11/472,038

(22) Filed: Jun. 21, 2006

(65) Prior Publication Data

US 2007/0295747 A1 Dec. 27, 2007

(51) Int. Cl.
*B67D 7/30* (2010.01)

(52) U.S. Cl. ..... 222/20; 222/14; 222/15; 222/16; 222/17; 137/487.5

(58) Field of Classification Search ..... 222/14, 222/22, 59, 74, 75, 63, 71, 15–17; 137/487.5, 137/486, 599.05

See application file for complete search history.

(56) References Cited

U.S. PATENT DOCUMENTS 3,323,681 A * 6/1967 Di Vette et al. ..... 222/129.1
5,230,443 A * 7/1993 Du ..... 222/134
6,036,055 A * 3/2000 Mogadam et al. ..... 222/23
7,306,115 B2 * 12/2007 Beachy ..... 222/20

* cited by examiner

*Primary Examiner* — Kevin P Shaver
*Assistant Examiner* — Melvin Cartagena
(74) *Attorney, Agent, or Firm* — Robert M. Downey, P.A.

(57) ABSTRACT

A measuring fluid dispenser for dispensing fluids in measured quantities has a user input device for generating at least one user input signal. A flow regulator provides a known fluid output flow rate by regulating fluid flow between an input port and an output port of the regulator. A first electronic valve is responsive to electronic signals, wherein a first electronic signal positions the first electronic valve in a flow permissive state, and a second electronic signal positions the first electronic valve in a flow restrictive (i.e. interrupting) state. The first electronic valve has a first valve input in fluid communication with the regulator output and also has a first valve output in fluid communication with a fluid output port. A processing unit is communicable with the user input device and is responsive to the user input signal, and is also in electronic communication with the first electronic valve for transmitting the electronic signals to the first electronic valve.

11 Claims, 7 Drawing Sheets

MEASURING FLUID DISPENSER

BACKGROUND OF THE INVENTION

1. Field of the Invention

The present invention relates to fluid dispensers and more particularly to an electronically controlled fluid dispenser for delivering preset volumes of a fluid.

2. Discussion of the Related Art

The process of food preparation often requires the use of measured quantities of water and other fluids. In many instances, precise measured amounts of water are required to properly prepare food items according to a specific recipe. These quantities are typically measured in cups and fractions of cups. However, when viewing international recipes, the fluid quantities are often measured according to the metric system of measurements, namely liters and fractions of liters. Water and other fluids, by their nature, are typically delivered to a food preparation location in bulk and not in convenient pre-measured volumes.

The method of measuring fluids has not changed over many decades of food preparation. In order to accurately measure these volumes of fluid, and water in particular, a food preparer utilizes a specific container designed for receiving fluids. This container may be a larger container incorporating various graduations marked thereon into which the fluid is poured from a bulk source until the level of fluid in the container reaches the marked graduation corresponding to the desired quantity. This method requires delivery of the bulk supply to be cut off at a precise moment. Otherwise, the measured quantity will be either insufficient, requiring the addition of minimal amounts to reach the desired quantity, or too great, requiring the removal of fluid from the graduated container. This iterative process can be time consuming and frustrating to the food preparer.

Alternatively, an individual container of a specific desired volume can be utilized such that the full volume of the container corresponds to the volume desired for use by the food preparer. In instances where a container of a specific quantity is not available, a combination of specific containers is often utilized to measure the desired fluid quantity. In any event, the need to pour or deliver fluid into a precise measuring vessel often results in accidental overflow of the measuring vessel with a resulting waste of food preparation ingredients and cleanup of any spillage that has occurred.

Thus what is desired is an accurate and convenient method of repetitively dispensing precise measured quantities of fluids to meet the needs of food preparation.

SUMMARY OF THE INVENTION

One embodiment of the present invention is a measuring fluid dispenser for dispensing fluids in measured quantities. The measuring fluid dispenser has a user input device for generating at least one user input signal. A flow regulator provides a known fluid output flow rate by regulating fluid flow between an input port and an output port of the regulator. A first electronic valve is responsive to electronic signals, wherein a first electronic signal positions the first electronic valve in a flow permissive state, and a second electronic signal positions the first electronic valve in a flow restrictive (i.e. interrupting) state. The first electronic valve has a first valve input in fluid communication with the regulator output and also has a first valve output in fluid communication a fluid output port. A processing unit is communicable with the user input device and is responsive to the user input signal. The processing unit is also in electronic communication with the first electronic valve for transmitting the electronic signals to the first electronic valve.

Another aspect of the present invention is a measuring fluid dispenser for dispensing fluids in measured volumes. A user input device generates at least one user input signal to designate a desired fluid volume. A fluid reservoir receives a bulk quantity of fluid. A pump has a pump input in fluid communication with the fluid reservoir and an output in fluid communication with flow regulator for providing a known fluid output flow rate. The flow regulator also has a regulator output. A first electronic valve is responsive to electronic signals, wherein a first electronic signal positions the electronic valve in a flow permissive state and a second electronic signal positions the electronic valve in a flow restrictive state. The electronic valve has a valve input in fluid communication with the regulator output and has a valve output in fluid communication with an output port. A processing unit communicates with the user input device and is responsive to the user input signal. The processing unit is in electronic communication with the first electronic valve for transmitting the electronic signals to the first electronic valve in order to open and close the valve.

Yet another embodiment of the present invention is a measuring fluid dispenser comprising a user input device for generating at least one user input signal. A flow regulator is connected to an input port and provides a known fluid output flow rate through a regulator output. A first electronic valve is responsive to electronic signals wherein a first electronic signal positions the first electronic valve in a flow permissive state and a second electronic signal positions the first electronic valve in a flow restrictive state. The first electronic valve has a first valve input in fluid communication with the regulator output and also has a first valve output in fluid communication with a fluid output port. A second electronic valve is also responsive to electronic signals wherein a first electronic signal positions the second electronic valve in a flow permissive state and a second electronic signal positions the second electronic valve in a flow restrictive state. The second electronic valve has a second valve input in fluid communication with the fluid input port and a second valve output in fluid communication with the fluid output port. A processing unit is communicable with the user input device and is responsive to the user input signal. The processing unit is in electronic communication with the first electronic valve and the second electronic valve for transmitting the electronic signals to the first and second electronic valves.

These and other advantages of the invention will be further understood and appreciated by those skilled in the art by reference to the following written specification, claims and appended drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 3:
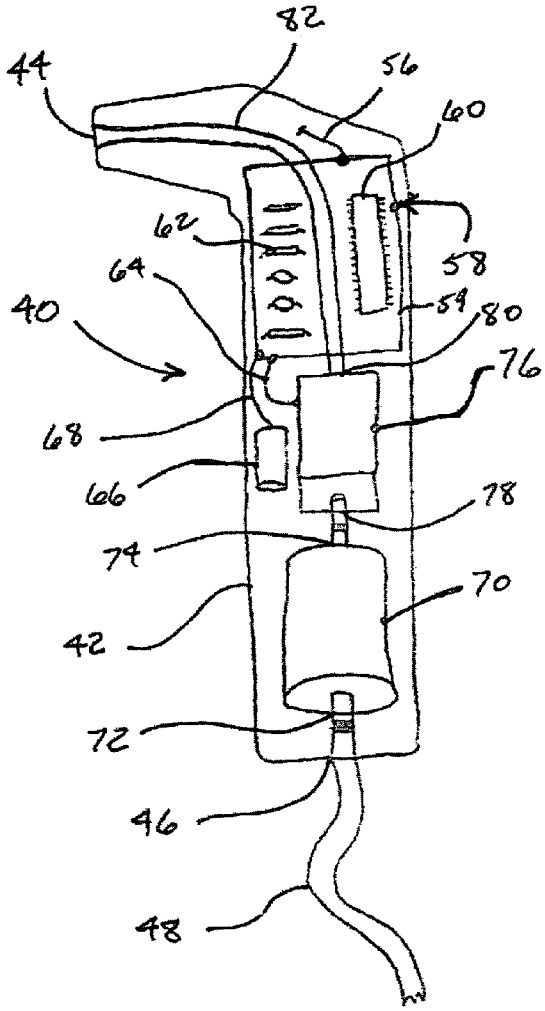
FIG. 3 is a cross-sectional elevation view of the fluid dispenser gun shown in FIG. 2.

For purposes of description herein, the terms "upper", "lower", "left", "rear", "right", "front", "vertical", "horizontal", and derivatives thereof shall relate to the invention as oriented in FIG. 3. However, one will understand that the invention may assume various alternative orientations and step sequences, except where expressly specified to the contrary. While the present invention has been shown and described in accordance with preferred and practical embodiments thereof, it is recognized that departures from the instant disclosure are fully contemplated within the spirit and scope of the invention. Hence, specific dimensions and other physical characteristics relating to the embodiments disclosed herein are not to be considered as limiting, unless the claims expressly state otherwise.

Figure 1:
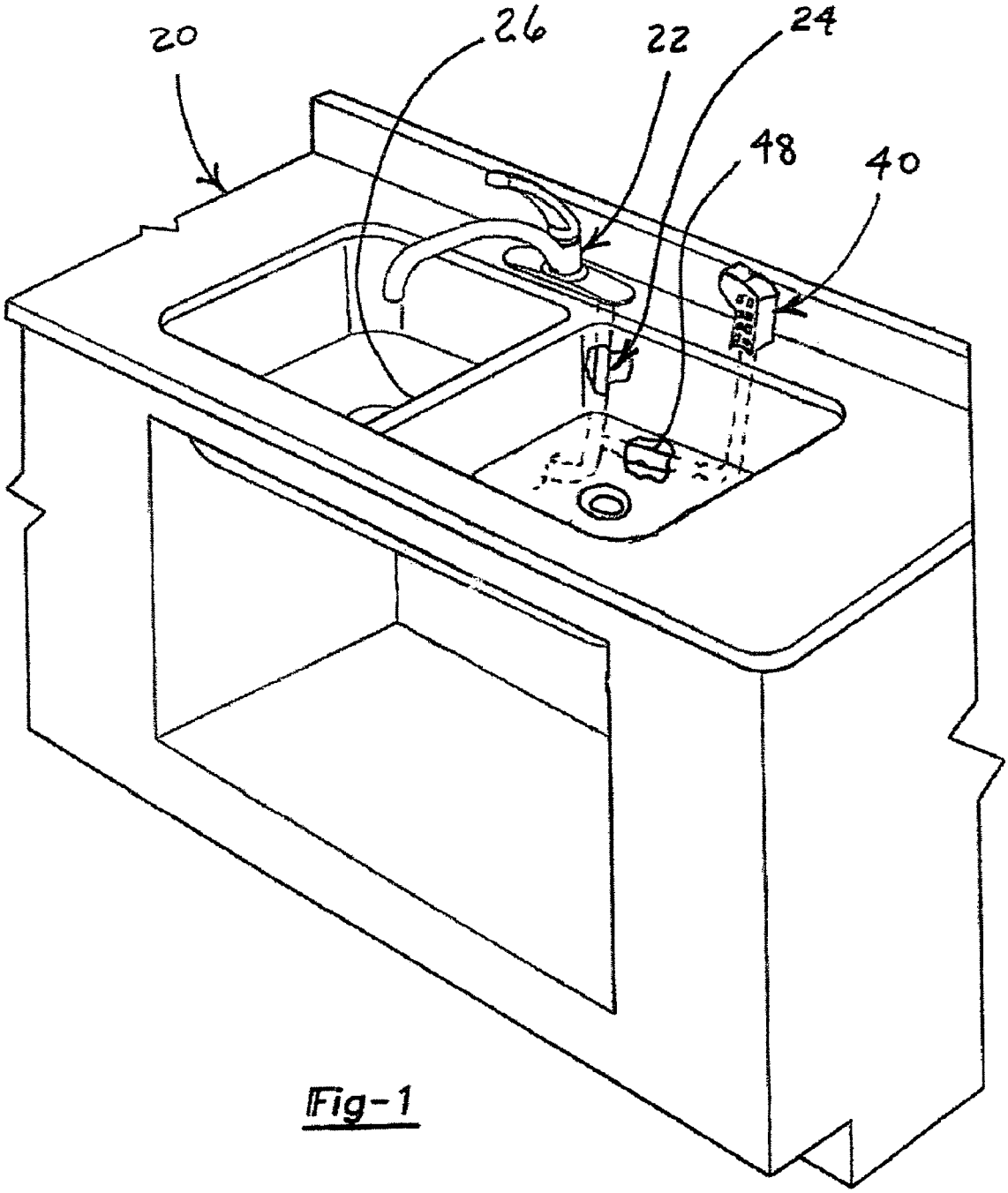
FIG. 1 is a perspective view of a measuring fluid dispenser embodying the present invention is shown installed at a kitchen sink.

Turning to the drawings, FIG. 1 shows a measuring fluid dispenser 40 which is one of the preferred embodiments of the present invention and illustrates its various components wherein the measuring fluid dispenser 40 is configured for dispensing water and is connected to a cold water supply line 24 with extendable tube 48. Cold water supply line 24 is typically part of the installation of sink 26 and faucet 22 in counter 20.

Figure 2:
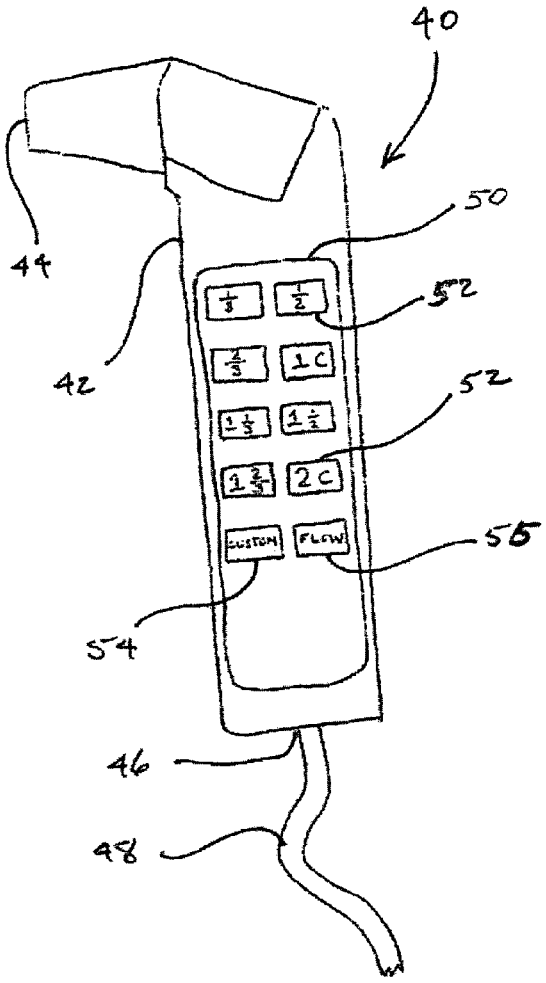
FIG. 2 is a elevation view of a fluid dispenser gun.

Turning now to FIGS. 2-3, a preferred embodiment of measuring fluid dispenser 40 is illustrated with its various components. Measuring fluid dispenser 40 comprises a housing 42, here configured as a handheld fluid dispenser gun. Housing 42 has a fluid input port 46 for receiving water through extendable tube 48 and in turn dispenses fluid through fluid output port 44. Fluid input port 46 is fluidly connected to a regulator input 72 for routing through flow regulator 70. Flow regulator 70 operates to regulate the flow of fluid therethrough at a known constant or fixed flow rate and is subsequently output through regulator output 74 at the known constant flow rate.

Regulator output 74 is fluidly connected to valve input 78 of first electronic valve 76. First electronic valve 76 responds to electronic signals from processing unit 58 through valve signal connection 64 and operates between a flow permissive state and a flow restrictive state. When a flow permissive signal is received by first electronic valve 76, the fluid output from regulator 70 is permitted to pass through first electronic valve 76 to first valve output 80 and then to fluid passageway 82 to be dispensed from fluid output port 44. When the desired quantity of fluid has been dispensed a flow restrictive signal is received by first electronic valve 76 which then closes and stops the flow of fluid.

The flow permissive and flow restrictive signals received by first electronic valve 76 across first valve signal connection 64 are generated by processing unit 58 which is powered by battery 66 and connected thereto with power connection 68. Processing unit 58 includes a circuit board 59 on which are electronically integrated various electronic components 62 and programmable microprocessor 60 for controlling the time interval during which fluid flow through regulator 70 is permitted to deliver a desired fluid volume from fluid dispensing gun 40.

A user input device 50, here shown as a keypad, is affixed to an exterior surface of the housing 42 and is electrically connected to processing unit 58 by interface signal connection 56. User input device 50 has a plurality of user interface keys 52 each of which has identified thereon a specific fluid volume (i.e. ½ cup, ⅓ cup, ⅔ cup, etc.). Each of the user interface keys 52, when activated by the user, generates a unique user input signal which is received by microprocessor 60 on processing unit 58. The microprocessor 60 associates the unique user input signal with the fluid volume identified on the activated key 52 producing the unique user input signal. The microprocessor 60 then sends a flow permissive signal to first electronic flow valve 76, determines the time interval required to dispense the fluid volume desired, and then when that time interval has elapsed sends a flow restrictive signal to first electronic flow valve 76 stopping the fluid flow from fluid output port 44.

In addition to the plurality of user interface keys 52 that are pre-programmed for specific fluid volumes, an additional user interface key 54 can be programmed by the user through a designated key sequence to microprocessor 60 for a custom fluid volume to be dispenses automatically whenever custom user interface key 54 is activated. Yet another key, such as a flow key 55 will, upon a first activation by the user, cause the microprocessor 60 to send a flow permissive signal to first electronic valve 76. The fluid flow continues until a second activation of flow key 55 whereupon microprocessor 60 sends a flow restrictive signal to first electronic valve 76 and stopping the fluid flow.

In operating dispenser 40, a user selects a desired fluid volume by activating a user interface key 52, 54, 55 on user interface device 50 associated with the desired fluid volume. The activated user interface key 52, 54, 55 generates a user input signal associated with the desired fluid volume which is received by microprocessor 60 on processing unit 58. Microprocessor 60 typically contains a unique program for calculating the time interval (T) between the flow permissive and flow restrictive signals transmitted to electronic valve 76. Since the fluid flow rate at output 74 of fluid regulator 70 is a known constant and the desired fluid volume to be delivered is known from the received user signal, the time interval during which the fluid is allowed to flow through electronic valve 76 can be readily calculated by microprocessor 60. This operation is based on the relationship $T=V/R$ (Where T is the time interval, V is the volume of fluid to be dispensed and R is the rate of fluid flow through the regulator 70).

Figure 4:
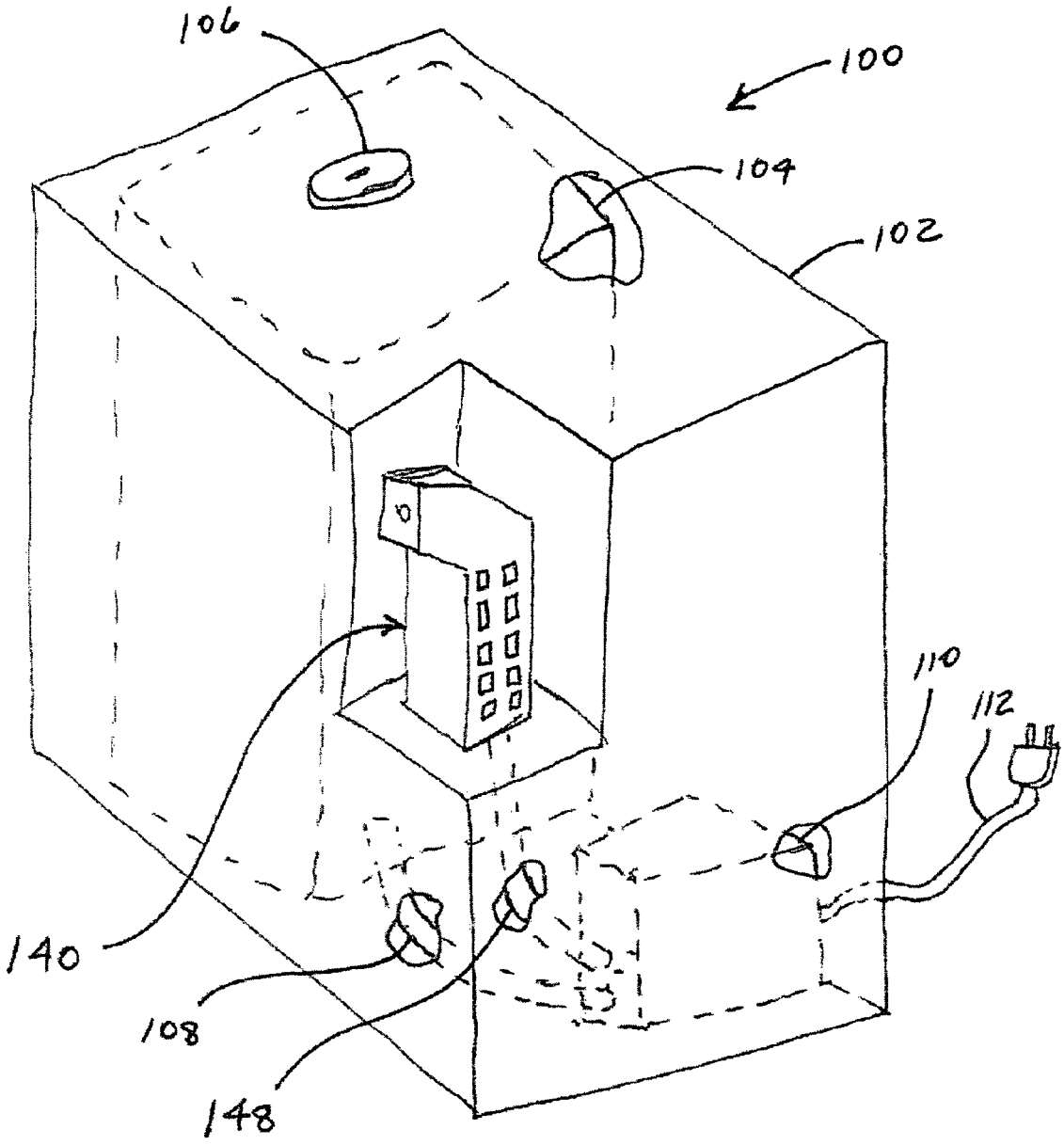
FIG. 4 is a perspective view of an alternate embodiment illustrating a self-contained countertop fluid dispensing unit.

Referring now to FIG. 4, In lieu of interconnecting the handheld measuring fluid dispenser 40 with the water supply associated with a sink 26, the handheld measuring fluid dispenser 140 can be utilized in a self-contained countertop fluid dispenser 100. Dispenser 100 comprises a container 102 within which is disposed a fluid reservoir 104. Reservoir 104 can be filled through fill port 106 with the fluid desired to be dispensed. A first supply tube 108 extends from reservoir 104 to a fluid pump 110. Fluid pump 110 is powered by normal household current through power cord 112 and operates to draw fluid from reservoir 104 and supply the fluid through extendable tube 148 to hand held fluid dispenser gun 140. Hand held fluid dispenser gun 140 is identical to handheld measuring fluid dispenser 40 with the addition that microprocessor 60 can also send a start signal to fluid pump 110 concurrent with or immediately prior to sending a flow permissive signal to first electronic valve 76. Extendable tube 148 has a considerable length such that fluid dispenser gun 40 can be extended from container 202 to reach the container in which the measured fluid is desired to be measured.

Figure 5:
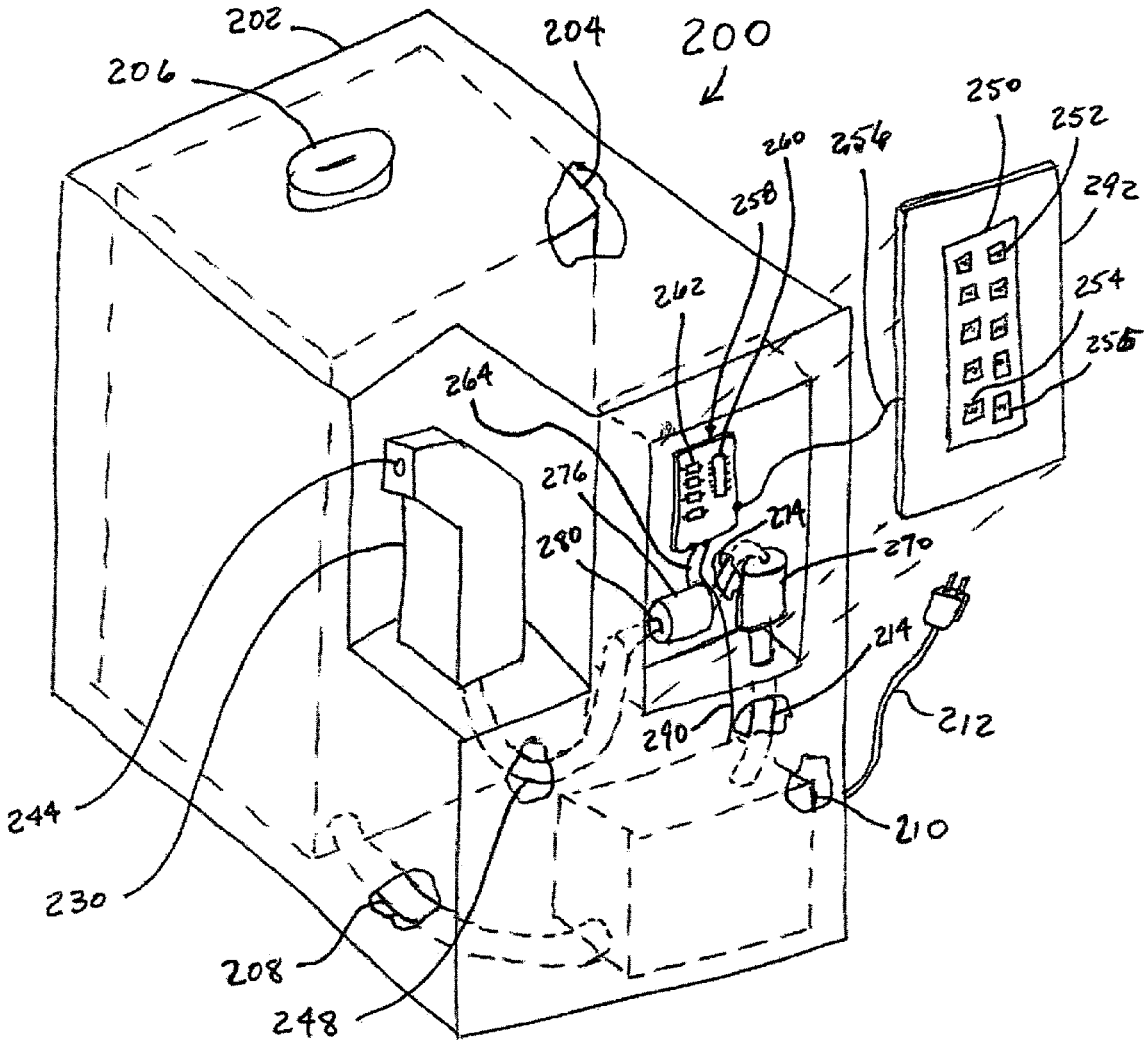
FIG. 5 is a perspective view of another self-contained countertop fluid dispensing unit

Referring now to FIG. 5, an alternate self-contained measuring fluid dispenser 200 is similar to dispenser 100 as described above; however, dispenser 200 incorporates the flow regulation components within container 202 instead of within a fluid dispenser gun. Like numbered features preceded by the numeral "2" function in like manner to the features preceded by the numeral "1" identified in FIG. 4, or by the features described above with respect to FIGS. 2-3.

Container 202 of dispenser 200 has disposed therein fluid reservoir 204 which can be filled through fill port 206 with a fluid to be dispensed. The various electrical components of dispenser 200 are powered by normal household electrical current through power cord 212. A first supply tube 208 extends from reservoir 204 to a fluid pump 210. Fluid pump 210 provides the energy necessary for the circulation of the fluid through dispenser 210. Second supply tube 214 delivers the circulated fluid from fluid pump 210 to flow regulator 270, the output of which is a fluid flow stream of a known volumetric rate. The volumetric fluid rate from regulator output 274 is directed to first electronic valve 276 which is operable between a flow permissive state and a flow restrictive state by the microprocessor 260 and electronic components 262 of processing unit 258.

A pump signal connection 290 provides the electrical connection from processing unit 258 to fluid pump 210 for transmitting ON and OFF signals to fluid pump 210 from processing unit 258. Pump signal connection 290 can also include a power conductor (not shown) running therewith for delivering low voltage electrical power transformed from input household current to electrically power processing unit 258.

In its flow permissive state, first electronic valve 276 outputs the fluid flow to extendable tube 248. Fluid dispenser gun 230 is connected to extendable tube 248 and can be removed from container 202 to extend to the container receiving the desired measured fluid. Fluid dispenser gun 230 has a fluid output port 244 for discharging the fluid into the receiving container. Alternatively, fluid dispenser gun 230 can be configured such that it is not removable from container 202 and fluid output port 244 is oriented such that the container for receiving the fluid may be placed therebelow to receive the measured fluid.

A user interface device 250 is mounted on an exterior surface of container 202 or (as shown) on an access panel 292. User interface device 250 is electrically connected to processing unit 258 with interface signal connection 256. User interface device 250 includes a plurality of user interface keys 252, each interface key 252 is associated with a unique fluid volume. Also, a programmable key 254 can be configured to signal the delivery of a user determined fluid volume and a flow key 255 can provide a continuous non-measured fluid flow. User input device 250 and keys 252, 254, 255 function in identical manner to input device 50 and keys 52, 54, 55 as described above with respect to FIGS. 2-3.

Figure 6:
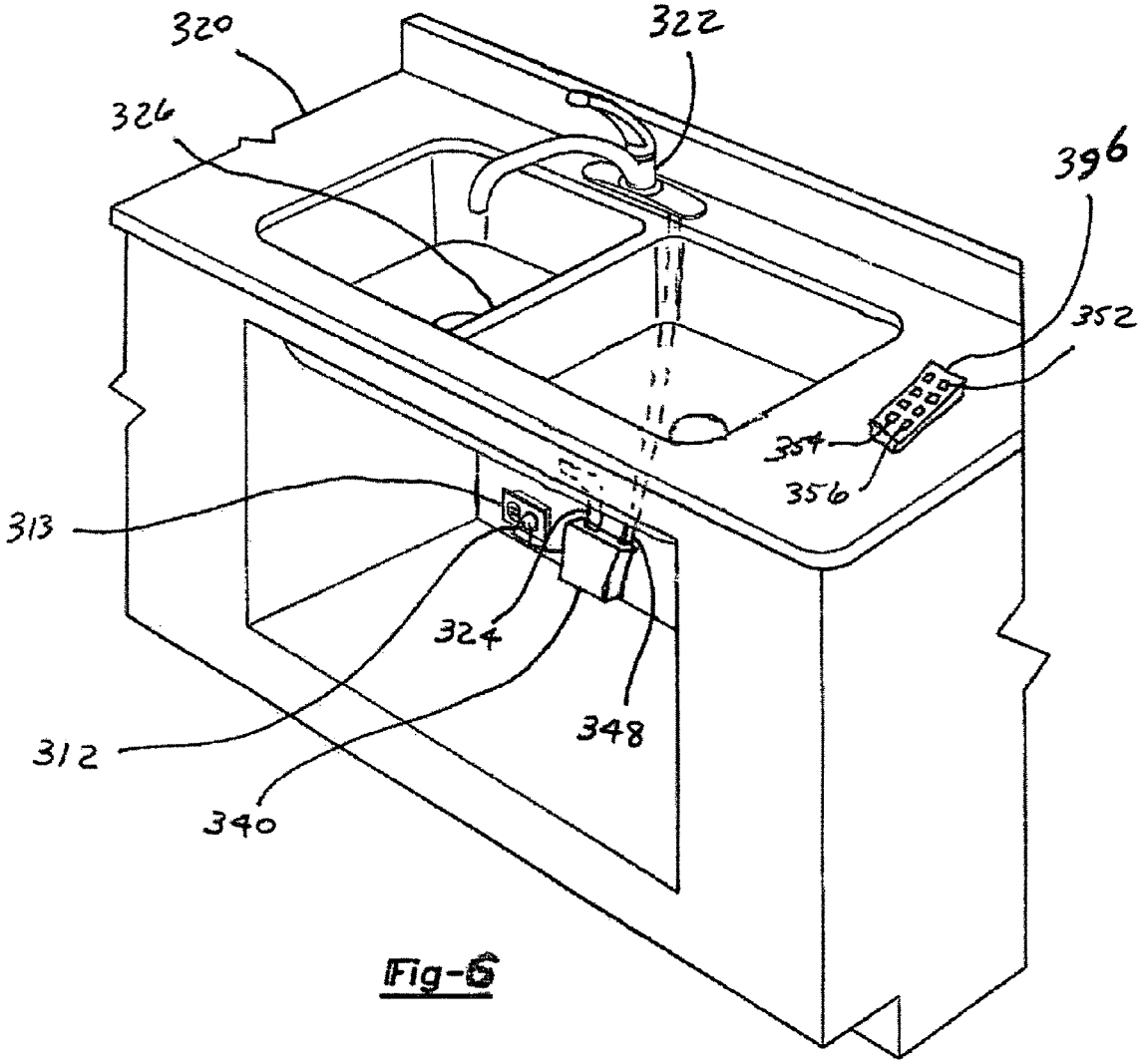
FIG. 6 is a perspective view of a measuring fluid dispenser embodying of the present invention and integrated with an existing water supply.
Figure 7:
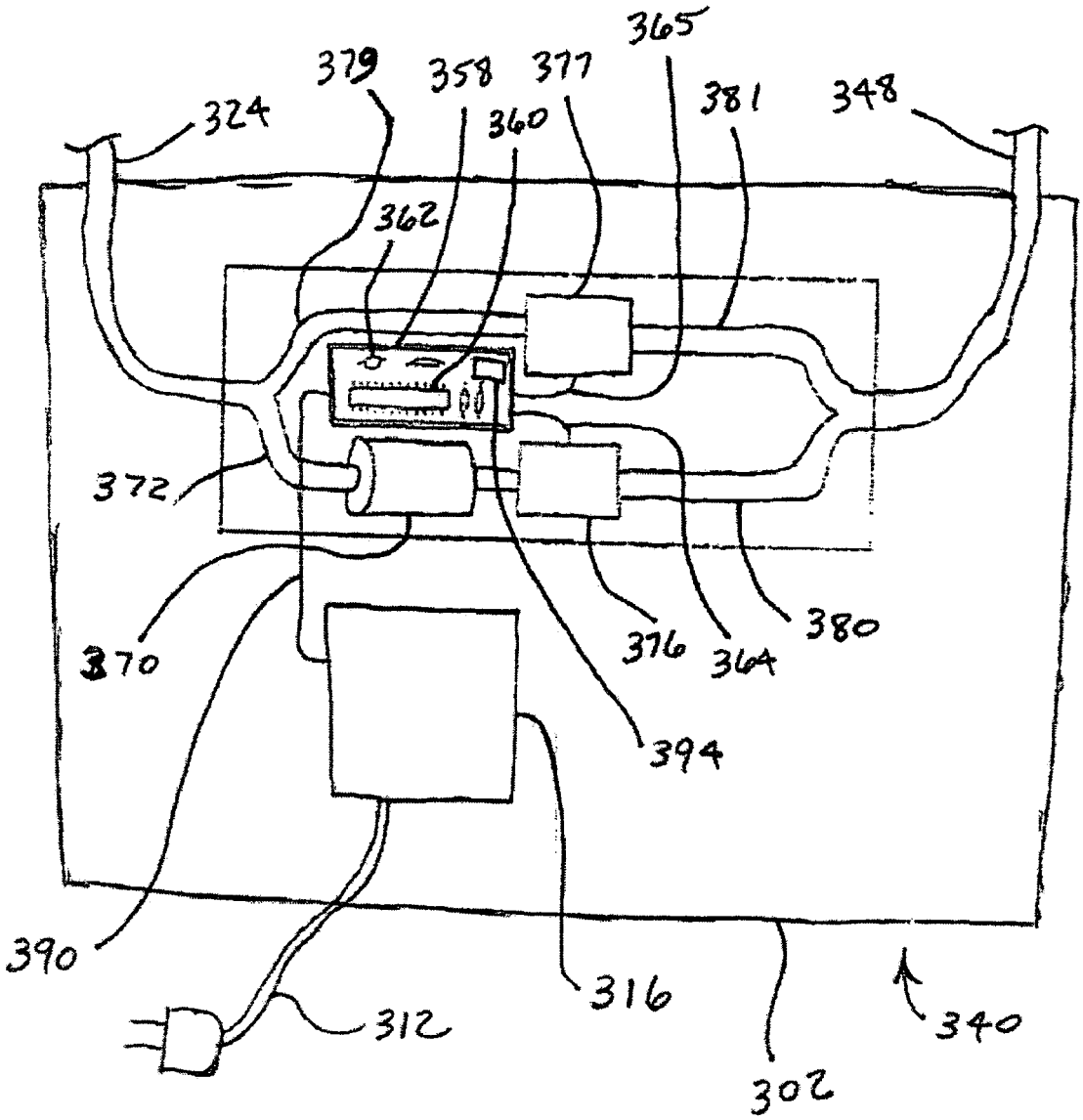
FIG. 7 is a schematic illustration of the fluid dispenser master unit of the water dispenser shown in FIG. 5.

Referring now to FIGS. 6-7, an integrated measuring fluid dispenser 340 is shown mounted below a kitchen sink 326 in a counter 320. Like numbered features preceded by the numeral "3" function in like manner to the features described above with respect to FIGS. 1-3. Dispenser 340 has a power cord 312 connected to a receptacle 313 for delivering household electrical power to dispenser 340. Cold water supply line 324 supplies water to dispenser 340 and tube 348 delivers the water output from dispenser 340 to faucet 322. User interface remote control 396 has a plurality of user interface keys 352, a user programmable key 354, and a flow key 355 which function in like manner to user interface device 50 as described above.

As shown in greater detail in FIG. 7, dispenser 340 has disposed in case 302 a transformer 316 for converting household electrical power to a lower voltage power delivered on power connection 390 to power processing unit 358. Regulator input 372 and second electronic valve input 379 of second electronic valve 377 are both connected to cold water supply line 324. Second electronic valve 377 has a second electronic valve output 381 connected to dispenser output 348 for delivering unregulated water flow to faucet 322. Second electronic valve 377 is also controlled by processing unit 358 in response to flow permissive and flow restrictive signals delivered via second valve signal connection 365. Second electronic valve is normally open such that activation of the cold water portion of faucet 322 will result in unregulated water flow through second electronic valve 377 of dispenser 340.

As described above regulator 370 is connected via its regulator input 372 for providing a known fluid flow rate to first electronic valve 376 which is normally closed and is responsive to flow permissive and flow restrictive signals from processing unit 358 via first electronic valve signal connection 364. First electronic valve output 380 from first electronic valve 376 is also connected to dispenser output 348.

Processing unit 358 includes a programmable microprocessor 360 and electronic components 362 in like manner as processing unit 50. Processing unit 358 further includes a receiver 394 which receives radiated signals from user interface remote control 396 and supplies the remote user signals to microprocessor 360.

In operation, when a user desires to obtain a measured quantity of water, the user activates cold water portion of faucet 322 which initiates a stream of cold water through normally open second electronic valve 377. The user activates one of user keys 352, 354, 356 on remote control 396 for the desired measured volume of water which in turn radiates the signal to receiver 394. Upon receiving the signal, receiver 394 transmits the signal to microprocessor 360. Microprocessor 360 delivers a flow restrictive signal to second electronic valve 377 via connection 365 whereupon second electronic valve 377 closes and stops the flow of water therethrough. After a preset time delay to allow the user to place the receiving container under faucet 322, microprocessor 360 sends a flow permissive signal to first electronic valve 376 restarting the flow of water from faucet 322 through flow regulator 370 for a time period corresponding to the volume of water desired by the user. Upon expiration of the time period corresponding to the desired water volume, a flow restrictive signal is transmitted to first electronic valve 376 stopping the flow of water from faucet 322. After a preset time delay to permit the user to remove the receiving container from the faucet, microprocessor 360 sends a flow permissive signal to second electronic valve 377 again starting unrestricted flow of water from faucet 322.

Figure 8:
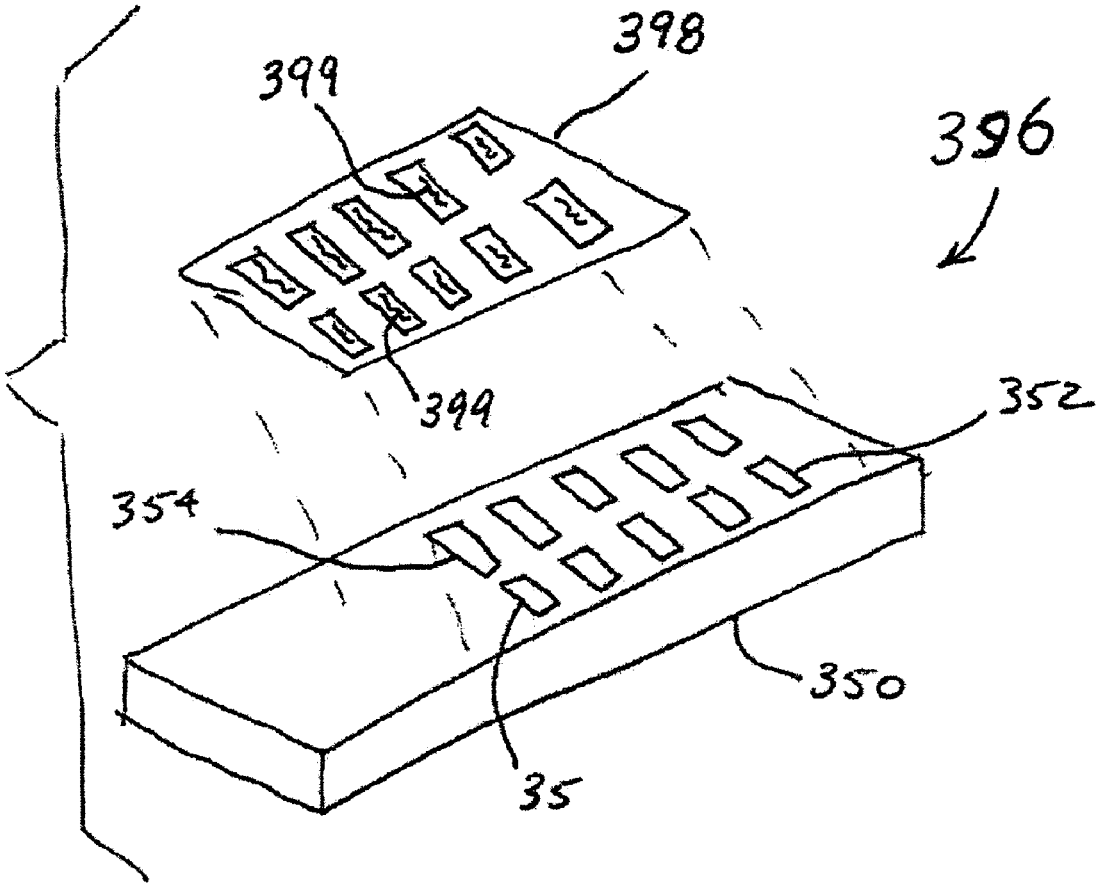
FIG. 8 is a partially exploded view of a remote unit for operating the fluid dispenser shown in FIG. 5.

Referring now to FIG. 8, remote control 396 comprises a remote user interface unit 350 which includes a plurality of user interface keys 352, 354, 355 which function as described above. Remote control 396 also includes an overlay membrane 398 having printed thereon a plurality of unique fluid volume nomenclatures 399. A plurality of interchangeable overlay membranes can be supplied with remote control 396 wherein each overlay membrane has printed thereon a different set of fluid volume nomenclatures 399 for designating different volumes from one membrane 398 to the next membrane 398. When a different set of volumes is desired (such as fractions of a cup versus fractions of a liter) a corresponding membrane 398 is affixed to user interface unit 350, and after entry of a unique key sequence via user keys 352, 354, 355 dispenser unit 340 is configured to deliver the fluid volumes designated on the new membrane 398. The use of interchangeable membranes 398 is also applicable in like manner for use on the measuring fluid dispensers 40, 200 and 300 described above.

As an alternative to the embodiment of FIGS. 6-8, the measuring fluid dispenser device may be manufactured as an attachment to the outlet of a standard plumbing fixture such as a faucet at a sink. In this instance, the device can be made to screw onto the threaded end of the spout opening on the faucet in a manner similar to water filters that are available on the market. In this variation of the embodiment of FIGS. 6-8, the device that attaches to the end of the faucet spout would contain the components shown in FIG. 7, with the exception of the power transformer and power cord, as the device would be battery powered. The manner of operation is similar to that described in connection with the embodiment of FIGS. 6-8.

In the foregoing description those skilled in the art will readily appreciate that modifications may be made to the invention without departing from the concepts disclosed herein. Such modifications are to be considered as included in the following claims, unless these claims expressly state otherwise.

What is claimed is:

1. A measuring fluid dispenser for dispensing water from a pressurized municipal water supply source comprising:

a housing having a fluid input port structured and disposed for fluid flow receiving connection to the pressurized municipal water supply source, and a fluid output port, wherein said housing is a handheld housing;

a user operated dispensing control device for generating user selected electronic operational control signals corresponding with measured volumes of water to be dispensed from the fluid output port, and said dispensing control device including a plurality of user interface keys, each of said user interface keys being associated with a predetermined specific water volume to be dispensed from the fluid output port of the housing in accordance with the selection of the user;

a flow regulator contained within said housing and having a regulator input disposed in fluid communication with the fluid input port of said housing and further having a regulator output, and said flow regulator being structured and disposed for receiving a pressurized flow of water from the pressurized municipal water supply source at variable pressures and fluid flow rates at the regulator input and for providing a known and constant volumetric fluid flow rate of the water at the regulator output;

a first electronic valve contained within said housing, downstream of said flow regulator, and disposed in fluid flow communication with the regulator output, and said first electronic valve being responsive to the user selected electronic operational control signals for operating said first electronic valve between a closed position, defining a water flow restrictive state, and an open position, defining a water flow permissive state, and said first electronic valve having a first valve input in fluid communication with the regulator output for receiving the known and constant volumetric fluid flow rate of the water and a first valve output in fluid communication with the fluid output port of said housing; and a processing unit contained within said housing and including a microprocessor communicating with said first electronic valve, said microprocessor being structured and disposed for delivering the user selected electronic operational control signals to said first electronic valve according to predetermined timed sequences corresponding with user selected measured volumes of water to be dispensed from the fluid output port of said housing, and the user selected electronic operational control signals including a first electronic operational control signal for positioning said first electronic valve in the flow permissive state, allowing the water to flow through the first electronic valve at the known and constant volumetric fluid flow rate, and the user selected electronic operational control signals further including a second electronic operational control signal for positioning said first electronic valve in the flow restrictive state, preventing the water from flowing through said first electronic valve and thereby stopping the flow of water through the fluid output port of said housing.

2. The measuring fluid dispenser according to claim 1 wherein said user operated dispensing control device is affixed to an outside surface of said handheld housing.

3. The measuring fluid dispenser according to claim 1 wherein at least one of said user interface keys is associated with a user programmable specified water volume to be dispensed from the fluid output port upon pressing the at least one of said user interface keys.

4. The measuring fluid dispenser according to claim 1 wherein said user operated dispensing control device includes an overlay membrane removably affixed over said user interface keys, said overlay membrane having printed thereon a plurality of unique water volume nomenclatures, each said nomenclature associated with a respective one of said user interface keys.

5. The measuring fluid dispenser according to claim 4 further including a plurality of overlay membranes, each of said overlay membranes identifying a unique set of water quantities associated with said user interface keys, and further wherein said processing unit is responsive to a unique user interface key sequence to associate each of said user interface keys with an identified volume of water on said overlay membrane.

6. The measuring fluid dispenser according to claim 1 further including:

a second electronic valve contained within said housing, and being responsive to at least some of the user selected electronic operational control signals, wherein a third electronic operational control signal positions said second electronic valve in a flow permissive state and a fourth electronic operational control signal positions said second electronic valve in a flow restrictive state, said second electronic valve having a second valve input in fluid communication with the fluid input port and a second valve output in fluid communication with the fluid output port, said second electronic valve further in electronic communication with said processing unit.

7. The measuring fluid dispenser according to claim 6 wherein said second electronic valve is in a normally open state permitting water flow therethrough.

8. The measuring fluid dispenser according to claim 7 wherein said processing unit, in response to a user input on said dispensing control device for a specific water quantity, transmits said fourth electronic operational control signal to said second electronic valve, initiates a first predetermined time delay, transmits said first electronic operational control signal, transmits said second electronic operational control signal to said first electronic valve after a second predetermined time delay associated with a specific water quantity, initiates a third predetermined time delay, and transmits said third electronic operational control signal to said second electronic valve.

9. A measuring fluid dispenser for dispensing water from a pressurized municipal water supply source comprising:

a housing having a fluid input port structured and disposed for fluid flow receiving connection to the pressurized municipal water supply source, and a fluid output port;

a user operated dispensing control device for generating user selected electronic operational control signals corresponding with measured volumes of water to be dispensed from the fluid output port, and said dispensing control device including a plurality of user interface keys, each of said user interface keys being associated with a predetermined specific water volume to be dispensed from the fluid output port of the housing in accordance with the selection of the user;

a flow regulator contained within said housing and having a regulator input disposed in fluid communication with the fluid input port of said housing and further having a regulator output, and said flow regulator being structured and disposed for receiving a pressurized flow of water from the pressurized municipal water supply source at variable pressures and fluid flow rates at the regulator input and for providing a known and constant volumetric fluid flow rate of the water at the regulator output;

a first electronic valve contained within said housing, downstream of said flow regulator, and disposed in fluid flow communication with the regulator output, and said first electronic valve being responsive to the user selected electronic operational control signals for operating said first electronic valve between a closed position, defining a water flow restrictive state, and an open position, defining a water flow permissive state, and said first electronic valve having a first valve input in fluid communication with the regulator output for receiving the known and constant volumetric fluid flow rate of the water and a first valve output in fluid communication with the fluid output port of said housing;

a processing unit contained within said housing and including a microprocessor communicating with said first electronic valve, said microprocessor being structured and disposed for delivering the user selected electronic operational control signals to said first electronic valve according to predetermined timed sequences corresponding with user selected measured volumes of water to be dispensed from the fluid output port of said housing, and the user selected electronic operational control signals including a first electronic operational control signal for positioning said first electronic valve in the flow permissive state, allowing the water to flow through the first electronic valve at the known and constant volumetric fluid flow rate, and the user selected electronic operational control signals further including a second electronic operational control signal for positioning said first electronic valve in the flow restrictive state, preventing the water from flowing through said first electronic valve and thereby stopping the flow of water through the fluid output port of said housing; and a second electronic valve contained within said housing and communicating with said processing unit, and said second electronic valve being responsive to at least some of the user selected electronic operational control signals, wherein a third electronic operational control signal positions said second electronic valve in a flow permissive state and a fourth electronic operational control signal positions said second electronic valve in a flow restrictive state, said second electronic valve having a second valve input in fluid communication with the fluid input port and a second valve output in fluid communication with the fluid output port, said second electronic valve further in electronic communication with said processing unit.

10. The measuring fluid dispenser according to claim 9 wherein said second electronic valve is in a normally open state permitting water flow therethrough.

11. The measuring fluid dispenser according to claim 10 wherein said processing unit, in response to a user input on said dispensing control device for a specific water quantity, transmits said fourth electronic operational control signal to said second electronic valve, initiates a first predetermined time delay, transmits said first electronic operational control signal, transmits said second electronic operational control signal to said first electronic valve after a second predetermined time delay associated with a specific water quantity, initiates a third predetermined time delay, and transmits said third electronic operational control signal to said second electronic valve.

* * * * *